US005456629A

United States Patent [19]

Bingham

[11] Patent Number: 5,456,629

[45] Date of Patent: Oct. 10, 1995

[54] METHOD AND APPARATUS FOR CUTTING AND ABRADING WITH SUBLIMABLE PARTICLES

[75] Inventor: Dennis N. Bingham, Idaho Falls, Id.

[73] Assignee: Lockheed Idaho Technologies Company, Idaho Falls, Id.

[21] Appl. No.: 178,533

[22] Filed: Jan. 7, 1994

[51] Int. Cl.[6] ..... B24C 1/00

[52] U.S. Cl. ..... 451/39; 451/102; 451/36

[58] Field of Search ..... 451/736, 38–40, 451/53, 75, 89, 99, 100, 102, 90; 134/6, 7, 8, 22.11, 22.12, 22.18, 37, 22.1, 102.1; 239/290

[56] References Cited

U.S. PATENT DOCUMENTS

| | | | |
|---|---|---|---|
| 3,979,981 | 9/1976 | Lightstone et al. | 83/15 |
| 4,038,786 | 8/1977 | Fong | 51/320 |
| 4,389,820 | 6/1983 | Fong | 51/410 |
| 4,447,952 | 5/1984 | Elkins | 30/361 |
| 4,589,203 | 5/1986 | Le Diouron | 29/829 |
| 4,631,250 | 12/1986 | Hayashi | 430/329 |
| 4,918,941 | 3/1980 | Hagler | 62/320 |
| 4,932,168 | 6/1990 | Tada et al. | 451/99 |
| 4,956,042 | 9/1990 | Hubert et al. | 156/344 |
| 4,963,205 | 10/1990 | Hubert | 156/80 |
| 5,018,667 | 5/1991 | Lloyd | 451/102 |
| 5,025,632 | 6/1991 | Spritzer | 62/64 |
| 5,062,898 | 11/1991 | McDermott et al. | 134/7 |
| 5,065,551 | 11/1991 | Fraser | 451/75 |
| 5,115,600 | 5/1992 | Katdoka et al. | 451/75 |
| 5,168,671 | 12/1992 | Kataoka et al. | 451/36 |
| 5,294,261 | 3/1994 | McDermott et al. | 134/7 |
| 5,341,608 | 8/1994 | Mains, Jr. | 451/39 |
| 5,363,603 | 11/1994 | Miller et al. | 451/40 |
| 5,390,450 | 2/1995 | Goenka | 451/39 |

FOREIGN PATENT DOCUMENTS

| | | | |
|---|---|---|---|
| 6152579 | 11/1981 | Japan | 451/38 |

*Primary Examiner*—Bruce M. Kisliuk
*Assistant Examiner*—Derris H. Banks
*Attorney, Agent, or Firm*—Klaas Law O'Meara & Matkin

[57] ABSTRACT

A gas delivery system provides a first gas as a liquid under extreme pressure and as a gas under intermediate pressure. Another gas delivery system provides a second gas under moderate pressure. The second gas is selected to solidify at a temperature at or above the temperature of the liquified gas. A nozzle assembly connected to the gas delivery systems produces a stream containing a liquid component, a solid component, and a gas component. The liquid component of the stream consists of a high velocity jet of the liquified first gas. The high velocity jet is surrounded by a particle sheath that consists of solid particles of the second gas which solidifies in the nozzle upon contact with the liquified gas of the high velocity jet. The gas component of the stream is a high velocity flow of the first gas that encircles the particle sheath, forming an outer jacket.

21 Claims, 5 Drawing Sheets

METHOD AND APPARATUS FOR CUTTING AND ABRADING WITH SUBLIMABLE PARTICLES

The United States Government has rights in this invention pursuant to Contract No. DE-ACO7-76IDO1570 between the U.S. Department of Energy and EG&G Idaho, Inc.

BACKGROUND OF THE INVENTION

FIELD OF THE INVENTION

This invention relates to sandblasting machines in general and more specifically to a method and apparatus for cutting and abrading with sublimable particles.

BACKGROUND OF THE INVENTION

Sandblasting is a generic term used to designate any of a series of processes in which small particles are propelled against a surface to effect changes at or on that surface. For example, sandblasting is commonly used to remove unwanted materials from the surfaces of objects by abrasion or erosion. However, sandblasting techniques have also been developed which can alter the physical condition of the surface of the object, such as by shot peening. Another technique for abrading materials is to use a high velocity water jet to achieve the desired surface treatment. Water jets can also be used to cut certain materials, much like a saw.

Unfortunately, however, both sandblasting and water jet technologies are not without their drawbacks. For example, sandblasting suffers from problems relating to the clean-up and removal of the abrasive particles after they have been used. Dust generation and atmospheric contamination are also problems that must be addressed. Likewise, water jet technology suffers from problems relating to the collection of the water released during the cutting or abrading operation, as well as problems relating to the possible contamination of the water from the eroded material.

Some of the foregoing problems have been solved by sandblasting devices that utilize sublimable particles, such as dry ice, as the abrasive material. The primary advantage of using sublimable particles (i.e., particles that change directly from a solid to a gas without a transition through the liquid state) in a sandblasting operation is that there is no secondary waste material to be collected: The dry ice particles change to gaseous carbon dioxide ($CO_2$) shortly after striking the surface of the object. The gaseous carbon dioxide can then be discharged into the atmosphere. Since carbon dioxide is present in the atmosphere in substantial quantities, venting the carbon dioxide gas into the atmosphere generally does not pose any problems.

The advantages associated with carbon dioxide sandblasting have made it a particularly useful process for decontaminating objects that were previously exposed to radioactive environments. In the typical decontamination process, the dry ice particles propelled against the object will penetrate the contaminated surface layer on the object and blast it away. Since the dry ice particles disappear due to sublimation, the remaining residue consists solely of the contaminated particles that were blasted from the surface of the object. In most cases, the remaining residue can then be easily collected and disposed of as waste, while the previously contaminated object can usually be recycled or disposed of in a conventional manner.

While such carbon dioxide, or dry ice, sandblasting has proven to be very beneficial, particularly in the area of treating hazardous materials, dry ice sandblasting is not a panacea, and many problems remain to be solved. For example, a common problem affecting most dry ice sandblasting devices relates to the creation and handling of the dry ice particles. After formation, the particles tend to agglomerate or clump together in the feed apparatus, thus creating feed problems and making it difficult to achieve a uniform distribution of particles within the blast stream. Furthermore, if the dry ice particles are not immediately injected into the nozzle, particle erosion due to sublimation tends to round off or smooth the sharp corners and edges of the particles, thus reducing their abrasiveness. Existing systems also tend to suffer from low particle densities, which further reduces effectiveness.

Fong in U.S. Pat. No. 4,038,786, attempts to solve some of these problems by using a hopper with a mechanical agitator and an anti-static device to minimize the tendency of the dry ice particles to clump together. Fong also uses a special nozzle and feed system in an attempt to improve the uniformity of the particle stream. Unfortunately, however, Fong's system suffers from other disadvantages, including insufficient particle velocity, non-uniformity and breaking of the dry ice particles, back-up and insufficient feed of particles into the gas stream and freezing occurring in the area of the feed mechanism and nozzle.

Recognizing the shortcomings of his earlier invention, Fong et. al. developed an improved system, which is disclosed in U.S. Pat. No. 4,389,820. The improved system is considerably more complex and includes a special pelletizer, rotary airlock, and nozzle, all of which were added in an attempt to solve some of the problems associated with his earlier invention. For example, the pelletizer includes special anti-static devices to help prevent clumping of the particles, while the rotary airlock represents an attempt to provide a more uniform supply of dry ice pellets to the nozzle. The special nozzle has a long and gradual taper to help accelerate the dry ice particles to higher velocities. Unfortunately, however, Fong's improved system is relatively complex and still tends to suffer from many of the problems typically associated with dry ice sandblasting, including particle degradation due to pre-blast sublimation, nozzle mixing problems, and particle storage and feed problems, just to name a few.

Consequently, there remains a need for a blasting device utilizing sublimable particles that can produce a high density, high velocity particle stream to maximize blasting effectiveness, yet maintain a uniform particle stream to ensure consistent and uniform surface treatment. Additional increases in blasting effectiveness could be achieved by reducing, or even eliminating, particle degradation due to pre-blast sublimation of the particles. Ideally, such a device would also eliminate the dry ice agglomeration problem, with all its associated disadvantages. Finally, additional utility could be realized if the device produced a small, high velocity particle stream capable of cutting a wide variety of materials.

SUMMARY OF THE INVENTION

Accordingly, it is a general object of this invention to provide a method and apparatus for cutting and abrading with sublimable particles.

Another object of the invention is to achieve a more uniform and consistent surface treatment.

It is a further object to increase the density of sublimable particles in the particle stream.

Yet another object of this invention is to provide a high velocity particle stream.

It is a yet a further object to provide a more uniform distribution of particles entrained in the stream.

Still another object of this invention is to minimize particle degradation due to pre-blast sublimation of the particles.

It is still yet a further object to provide a particle stream capable of cutting a wide variety of materials.

Additional objects, advantages, and novel features of this invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purposes of the present invention, as embodied and broadly described herein, the apparatus for cutting and abrading with sublimable particles according to this invention may comprise a gas delivery system for providing a first gas which is in a liquid state under extreme pressure and in a gaseous state under intermediate pressure. Another gas delivery system provides a second gas under moderate pressure. The second gas is selected so that it will solidify at a temperature at or above the temperature of the liquified first gas. A nozzle assembly connected to the gas delivery systems produces a stream containing a liquid component, a solid component, and a gas component. The liquid component of the stream consists of a high velocity jet of liquified first gas. The high velocity jet is surrounded by a particle sheath consisting of solid particles of the second gas, the second gas solidifying in the nozzle assembly upon contact with the liquified first gas of the high velocity jet. The gas portion of the stream forms an outer jacket around the particle sheath and consists of a high velocity flow of the first gas.

The method of cutting and abrading with sublimable particles according to the present invention includes the steps of: Creating a high velocity jet of liquified gas by passing a first gas in liquid form through a first nozzle; directing the high velocity jet of liquified gas through a second nozzle; passing a second gas through the inlet of the second nozzle so that the second gas comes in contact with the high velocity jet of liquified gas, the second gas solidifying when contact is made with the liquified gas in the high velocity jet, thus forming a particle sheath adjacent the high velocity jet of liquified gas; directing the high velocity jet of liquified gas and particle sheath from the second nozzle into a third nozzle; and passing a supply of first gas in vapor form through the inlet of the third nozzle so that the first gas in vapor form flows around the particle sheath in order to form a jacket around the sheath.

BRIEF DESCRIPTION OF THE DRAWINGS

The accompanying drawings, which are incorporated herein and form a part of the specification illustrate preferred embodiments of the present invention, and together with the description, serve to explain the principles of the invention. In the drawings.

DETAILED DESCRIPTION OF THE PREFERRED EMBODIMENT

Figure 1:
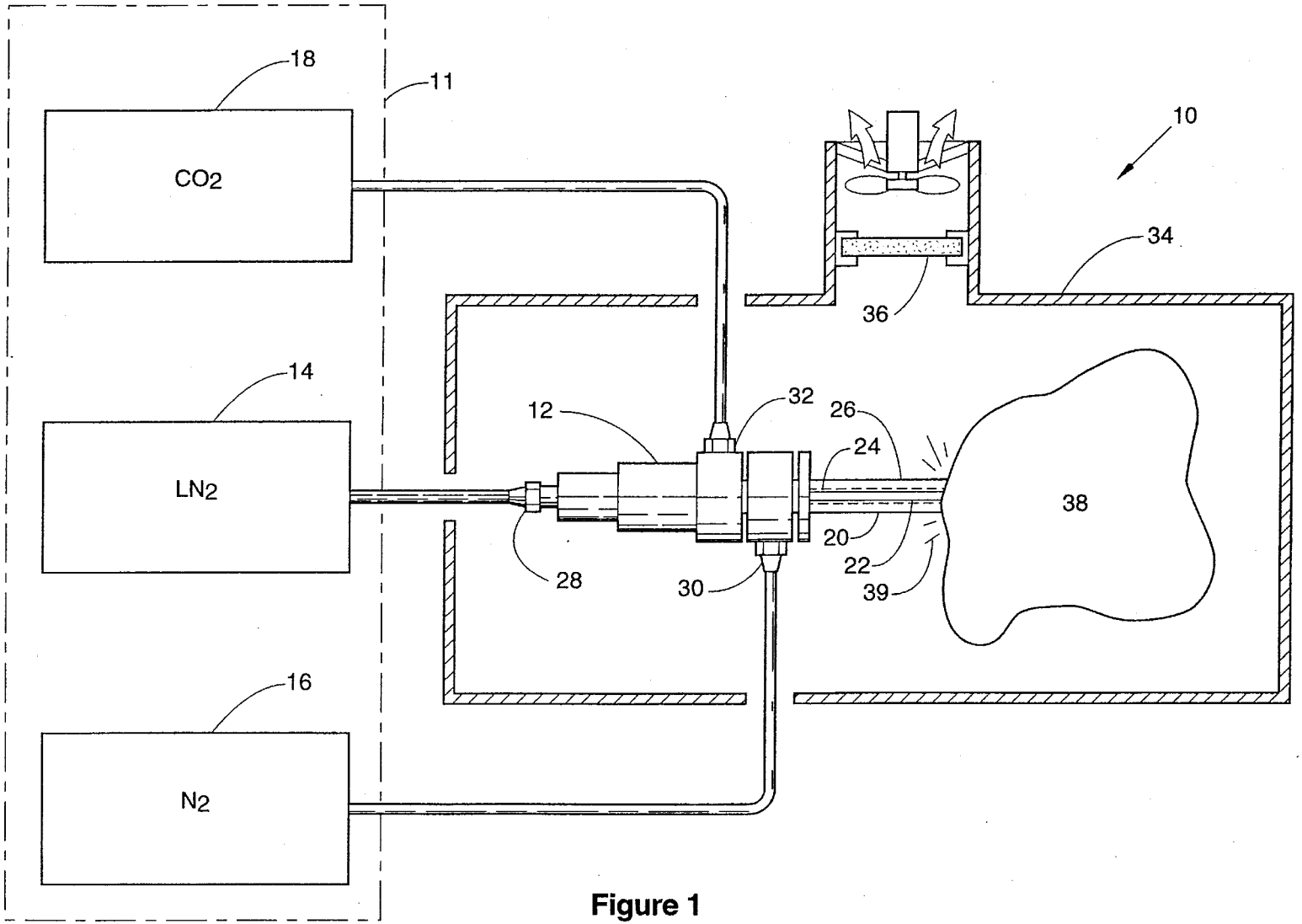
FIG. 1 is a block schematic diagram of the system for cutting and abrading with sublimable particles according to the present invention.

The cutting and abrading system 10 according to the present invention is shown in FIG. 1 and includes a fluid delivery system 11 for delivering liquid nitrogen, gaseous nitrogen, and gaseous carbon dioxide under various pressures to a tri-state nozzle assembly 12. More specifically, the fluid delivery system 11 includes a liquid nitrogen subsystem 14, a gaseous nitrogen subsystem 16, and a gaseous carbon dioxide subsystem 18. As will be described in greater detail below, the tri-state nozzle assembly 12 produces a stream 20 (shown enlarged in FIG. 1 for clarity having a high velocity liquid nitrogen jet 22 surrounded by a particle sheath 24 of solid carbon dioxide particles (dry ice). A high velocity gaseous nitrogen outer jacket 26 surrounds the carbon dioxide particle sheath 24 and is concentric with both the high velocity liquid nitrogen jet 22 and particle sheath 24. The stream 20 produced by the nozzle assembly 12 thus includes materials in the liquid, solid, and gas states, hence the term "tri-state." In the preferred embodiment, the nozzle assembly 12 and object 38 being treated are enclosed by a waste collection subsystem 34 which collects the nitrogen and carbon dioxide gases, vaporizes any remaining liquid nitrogen or dry ice particles, and discharges these materials into the atmosphere through a high efficiency particulate air filter 36. The waste collection subsystem 34 may also include a device (not shown) for collecting and removing material 39 abraded from the object 38.

A significant advantage of the cutting and abrading system 10 according to the present invention is that it achieves a high density, high velocity, uniform particle stream to maximize blasting effectiveness and to ensure more consistent and uniform surface treatment. Also, while the high velocity particle stream 20 can be used to erode the surface of an object, as in conventional sandblasting operations, it can also be used to cut a wide variety of materials if the stream 20 is maintained in a perpendicular orientation relative to the object surface.

Another advantage of the present invention is that since the carbon dioxide particles are formed within the nozzle assembly 12 itself and remain in intimate contact with the high velocity liquid nitrogen jet 22, loss of particle abrasiveness due to erosion by sublimation is minimized, if not eliminated entirely.

Additional advantages result from the use of carbon dioxide gas to form the dry ice particles within the nozzle assembly 12 itself. For example, since the carbon dioxide gas solidifies upon contact with the high velocity liquid nitrogen jet 22, the present invention can achieve higher particle densities and velocities. Also, it is much easier to achieve uniform dry ice particle entrainment within the stream. Of course, the use of carbon dioxide gas also eliminates the need for apparatus to first solidify the gas then feed the solid carbon dioxide particles to the nozzle. Consequently, the present invention does not encounter problems relating to particle agglomeration, particle feed discontinuities, and non-uniformity and breaking of particles.

Figure 2:
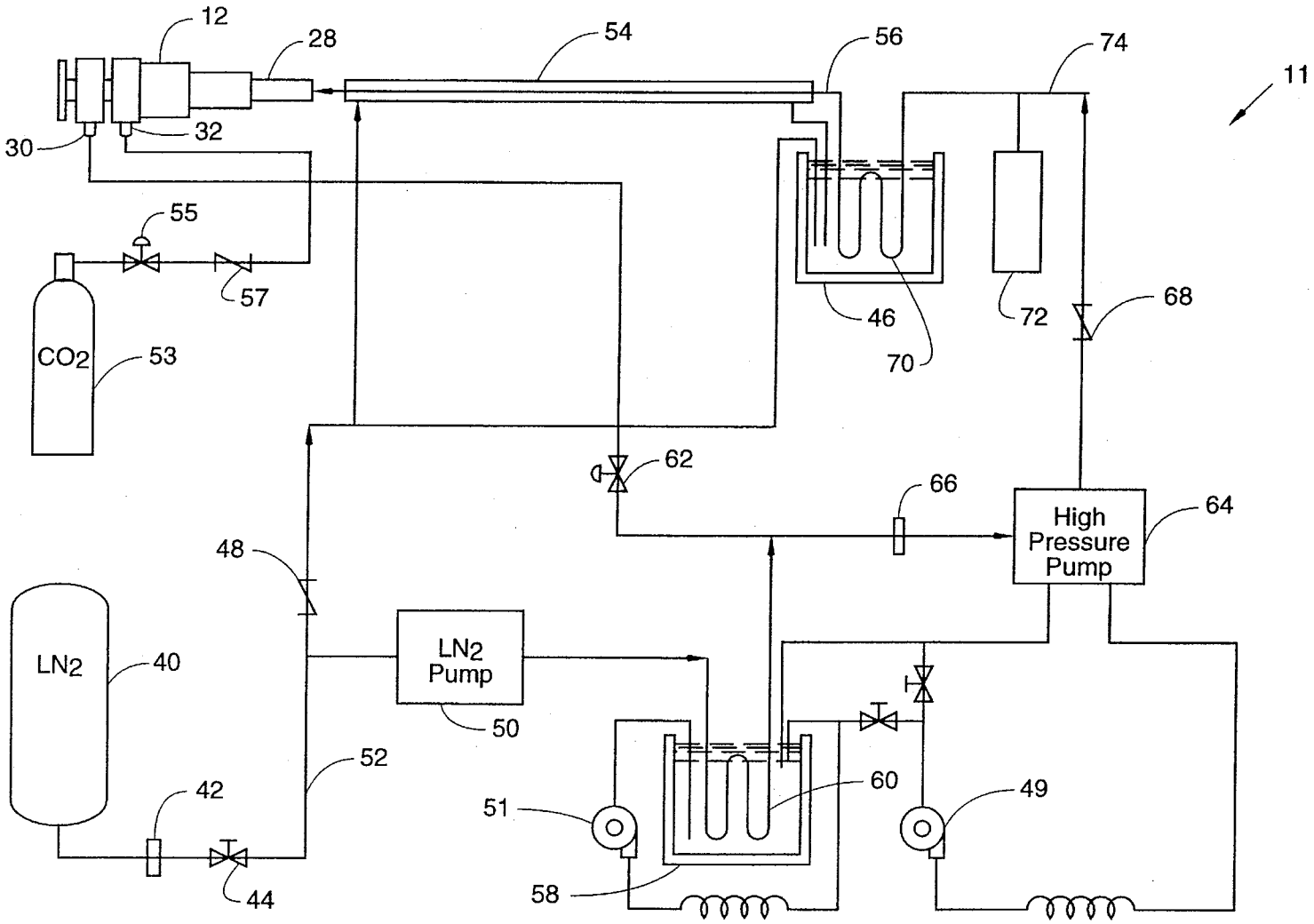
FIG. 2 is a detailed schematic diagram of the cutting and abrading system shown in FIG. 1, showing one possible configuration of the liquid nitrogen, gaseous nitrogen, and gaseous carbon dioxide delivery systems.

Before proceeding with a detailed description of the present invention, it should be noted that the three fluid delivery subsystems 14, 16, and 18 shown in FIG. 1 are integrated into a single, combined fluid delivery system 11 in the embodiment shown in FIG. 2. Therefore, instead of separately describing the three individual subsystems 14, 16, and 18 shown in FIG. 1, the following description is directed to the entire fluid delivery system 11 as an integrated unit.

It should also be noted that FIG. 2 only shows those fluid devices in the fluid delivery system 11 that are necessary to provide an enabling disclosure. FIG. 2 does not show, nor does the following description describe, other components, such as additional pressure regulators, check valves, filters, or compressor cooling systems, etc., that would be generic to such fluid delivery systems or that may be required for certain installations. Since systems for delivering pressurized gases and cryogenic liquids have existed for decades and are well known, it would be obvious to persons having ordinary skill in the art to add to the system shown and described herein those additional components that may be necessary or desirable for a specific installation.

Referring now to FIG. 2, both the liquid and gaseous nitrogen delivered to the nozzle assembly 12 originate from a single liquid nitrogen supply tank 40. After passing through a strainer 42 and valve assembly 44, a portion of the liquid nitrogen from tank 40 is drawn off and compressed to a pressure of about 6,000 pounds per square inch gauge (psig) by a liquid nitrogen pump 50 connected to supply line 52. As will be described in more detail below, the pressurized liquid nitrogen from pump 50 will ultimately be vaporized and a portion injected into the nozzle assembly 12 to form the high velocity gaseous nitrogen outer jacket 26 (FIG. 1). The remaining vaporized nitrogen will be compressed to an even higher pressure, liquified, and injected into the nozzle assembly 12 to form the high velocity liquid nitrogen jet 22. A portion of the liquid nitrogen from tank 40 is also diverted to a reverse flow cooling jacket 54 surrounding high pressure liquid nitrogen line 56 to keep the high pressure liquid nitrogen from boiling before it reaches the nozzle assembly 12. The liquid nitrogen from the reverse flow cooling jacket 54 is then discharged into a liquid nitrogen bath 46, the level of which is primarily maintained by liquid nitrogen from tank 40 flowing through a check valve 48. As will be described in more detail below, the liquid nitrogen in bath 46 is used to cool and liquify the high pressure nitrogen gas from high pressure pump 64.

After being compressed by pump 50, the high pressure liquid nitrogen is gassified and warmed to a temperature of about −30° F. by passing it through a heat exchanger 60 in a warming bath 58. In the preferred embodiment, the warming bath 58 is filled with a glycol-water mix that is maintained at a temperature of about −20° F. by a pump and heat exchanger assembly 51.

A portion of the gaseous nitrogen from the heat exchanger 60 is injected into the nitrogen inlet 30 in nozzle assembly 12 and forms the high velocity gaseous nitrogen outer jacket 26 of stream 20 (FIG. 1). To achieve the desired velocity of about 3,000 feet per second, the gaseous nitrogen must be injected into the nozzle assembly 12 under considerable pressure. In the preferred embodiment, a pressure regulating valve 62 is used to regulate the pressure of the gaseous nitrogen to about 6,000 psig. However, gaseous nitrogen pressures anywhere from 0 psig to 6,000 psig may be used depending on the desired characteristics of the stream 20. For example, if no gaseous nitrogen is injected, the liquid nitrogen jet 22 and particle sheath 24 will tend to feather, which may be desirable for certain operations.

The liquid nitrogen for the high velocity liquid nitrogen jet 22 originates from a high pressure intensifier pump 64, which draws off some of the nitrogen gas from the heat exchanger 60 via inlet filter 66. In the preferred embodiment, the high pressure intensifier pump 64 compresses the nitrogen gas to a pressure of about 60,000 psig, although pressures in the range of about 30,000 to 70,000 psig can be used depending on the desired velocity of the particle stream. Optionally, a cooling system 49 for the high pressure pump 64 may be integrated with heat exchanger assembly 51 as a convenient means for rejecting waste heat from pump 64 and for maintaining the warming bath 58 at the desired temperature.

The highly pressurized nitrogen gas from pump 64 passes through a check valve 68 before entering a heat exchanger 70 in cooling bath 46. As briefly described above, cooling bath 46 liquifies the pressurized nitrogen gas and cools it to a temperature of about −240° F. The cooled, liquified nitrogen gas, still under a pressure of about 60,000 psig, is then injected into the liquid nitrogen inlet 28 of nozzle assembly 12 via inlet line 56. Finally, an accumulator 72 connected to high pressure nitrogen line 74 helps to remove pressure variations from the pump 64.

Gaseous carbon dioxide is fed into the carbon dioxide inlet 32 of tri-state nozzle assembly 12 from a carbon dioxide tank 53 via a pressure regulating valve 55 and check valve 57. In the preferred embodiment, the gaseous carbon dioxide is delivered to the nozzle assembly 12 at a pressure in the range of about 20 psig to 800 psig. However, carbon dioxide delivery pressures in the range of about 20 to 2,000 psig will produce satisfactory results. The gaseous carbon dioxide can be delivered over a wide range of pressures depending on the stream characteristics desired. For example, low carbon dioxide delivery pressures generally produce a relatively thin particle sheath 24 (FIG. 1), resulting in light to moderate abrasive action. Higher delivery pressures generally produce a thicker particle sheath 24, with the particles possibly entrained even deeper within the high velocity liquid nitrogen jet 22 (FIG. 1), thus resulting in greater abrasive action. Therefore, it may be desirable or appropriate to vary the carbon dioxide delivery pressure depending on the nature of the material being abraded or on the particular abrasive action desired.

Figure 3:
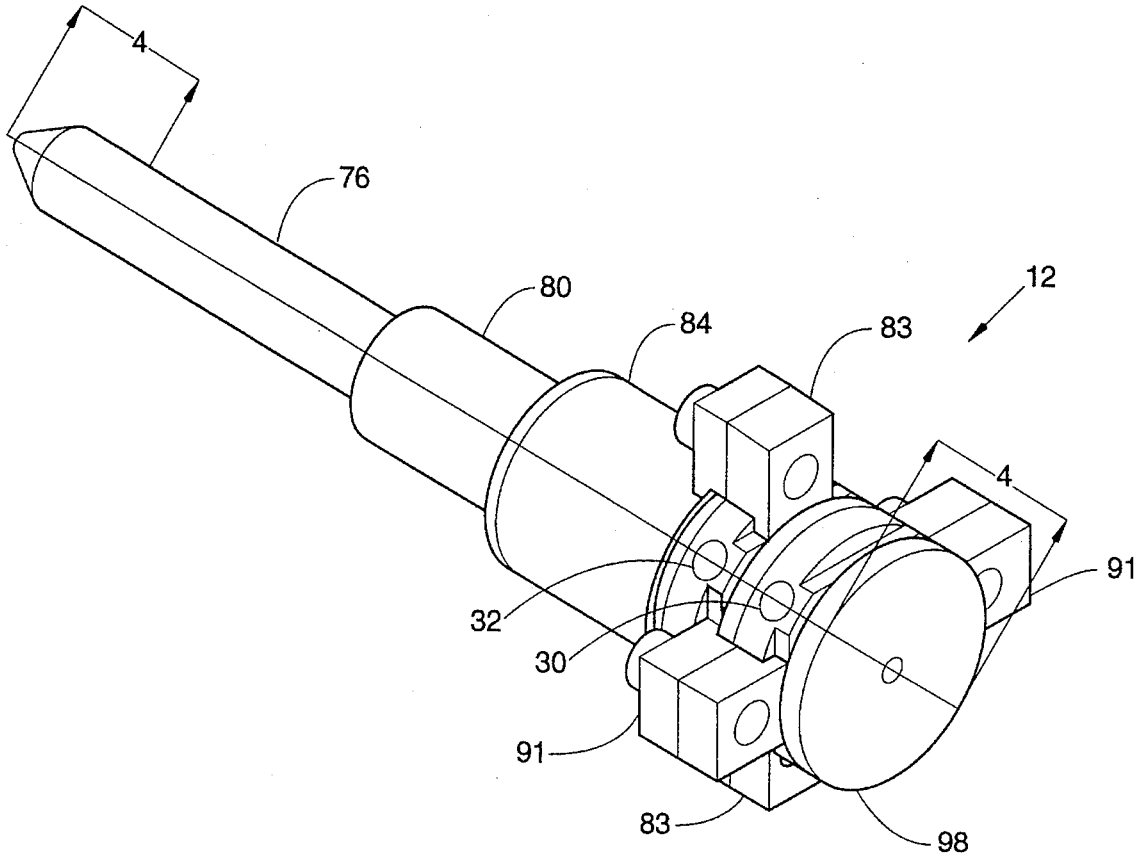
FIG. 3 is a perspective view of a continuous flow tri-state nozzle assembly used in the system of FIG. 1.
Figure 4:
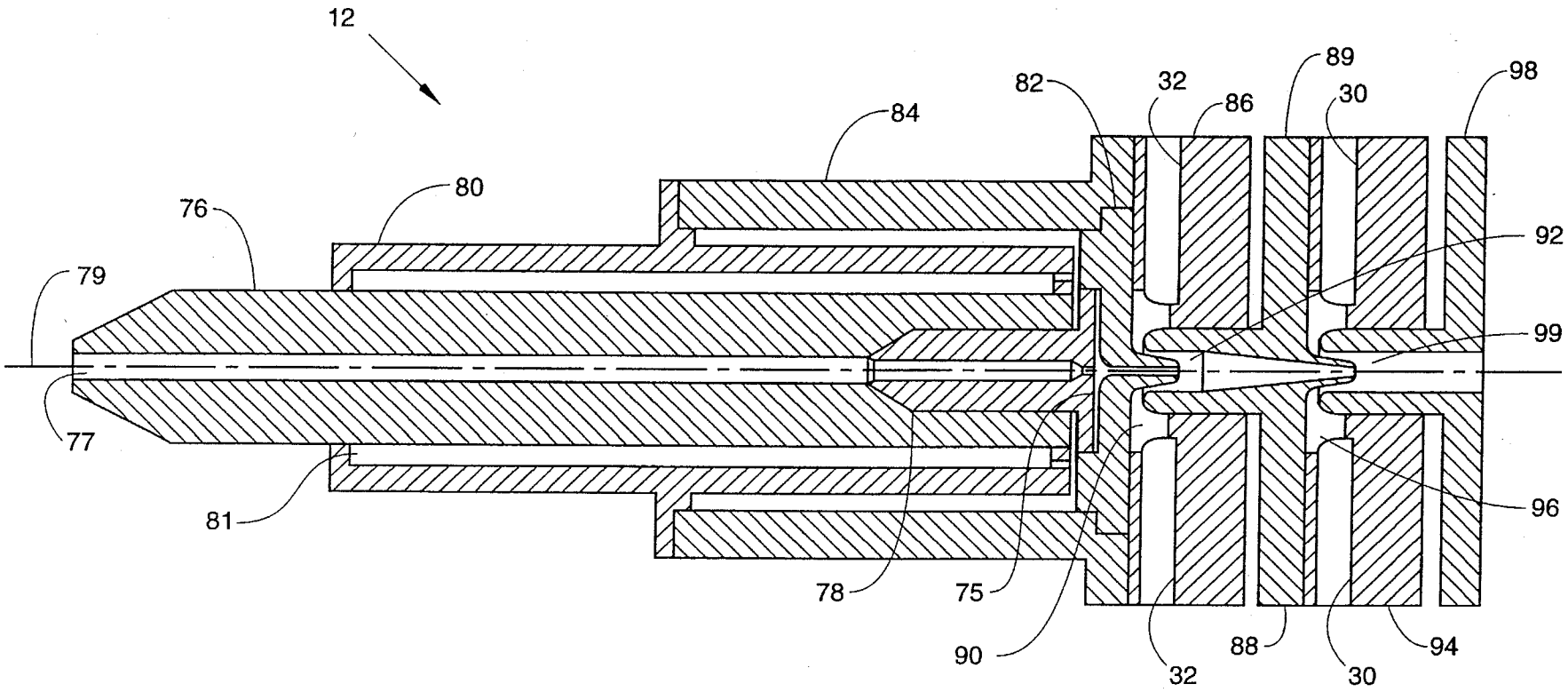
FIG. 4 is a cross section view of the continuous flow nozzle assembly shown in FIG. 3 taken along the plane 4—4.

A continuous flow nozzle assembly 12 is shown in FIGS. 3 and 4 and comprises an elongated liquid nitrogen barrel 76 having a flow restricting orifice plug 78 (FIG. 4) at one end. An insulating housing 80 surrounds barrel 76 and defines an annular insulation space 81 between barrel 76 and housing 80 to prevent the liquid nitrogen flowing through passage 77 from absorbing excess heat from the nozzle assembly 12 and possibly boiling. A first nozzle 82 mounted to main support housing 84 is positioned adjacent orifice plug 78 and aligned with flow axis 79 so that a small gap 75 is created therebetween. A first base plate 86 mounted to main support housing 84 by a pair of clamp assemblies 83 (FIG. 3) defines, in combination with first nozzle 82, a first chamber 90 that is fluidically connected to an opposed pair of carbon dioxide inlets 32. A second nozzle 88 is mounted to the first base plate 86, so that it is also aligned with flow axis 79. The second nozzle 88 is positioned a spaced distance from the first nozzle 82, so that a small annular gap 92 exists between the nozzles 82 and 88.

A second base plate 94 is mounted to a flange 89, which is part of the second nozzle 88, by a pair of clamp assemblies 91, as shown in FIG. 3. The second base plate 94, together with second nozzle 88, defines a second chamber 96 that is fluidically connected to the nitrogen inlet 30. Actually, the nozzle assembly 12 shown in FIGS. 3 and 4 includes opposed pairs of both the carbon dioxide inlets 32 and the nitrogen inlets 30, as opposed to the respective single inlets 32 and 30 shown in FIG. 1. While either configuration will work, using a pair of opposed inlets has the advantage of providing increased flow rates with reduced frictional losses. Finally, a third nozzle 98, aligned with flow axis 79, is mounted to the second base plate 94 and is positioned a spaced distance from the second nozzle 88, so that a small annular gap 99 is defined between the second nozzle 88 and the third nozzle 98.

During operation, the ultra high pressure liquid nitrogen from pump 64 flows through passage 77 and into the flow restricting orifice plug 78. A fine stream of liquid nitrogen leaves orifice plug 78 at a high velocity and enters the first nozzle 82. As the high velocity liquid nitrogen jet enters the first nozzle 82 it drags along with it air molecules within gap 75, thus evacuating gap 75 to provide additional thermal insulation between the nozzle assembly 12 and the liquid nitrogen within barrel 76. After passing through the first nozzle 82, the liquid nitrogen jet then enters the second nozzle 88. A positive pressure differential between the carbon dioxide gas which enters the first chamber 90 and the interior of nozzle 88 forces the carbon dioxide gas within chamber 90 into the nozzle 88 through the small annular gap 92. Upon contact with the liquid nitrogen stream, the gaseous carbon dioxide solidifies and forms the dry ice particle sheath 24 that surrounds the high velocity liquid nitrogen jet 22 (FIG. 1). Similarly, high pressure nitrogen gas which enters the second chamber 96 passes through the annular gap 99 between the second and third nozzles 88, 98 and forms the high velocity outer jacket 26 (FIG. 1). As described above, the high velocity gaseous nitrogen outer jacket 26 prevents feathering of the stream 20 and helps to maintain the integrity of the liquid nitrogen jet 22 and particle sheath 24.

With a liquid nitrogen pressure of about 60,000 psig, a gaseous nitrogen pressure of about 6,000 psig, and a carbon dioxide pressure in the range of about 20 psig to 800 psig, the nozzle assembly 12 shown in FIGS. 3 and 4 will produce a stream 20 having a velocity in excess of 3,000 feet per second, with the speeds of the liquid nitrogen jet 22, dry ice particle sheath 24, and gaseous nitrogen outer jacket 26 all being substantially equal.

While the nozzle assembly 12 shown in FIGS. 3 and 4 produces a continuous stream 20, and is, therefore, suitable for many uses, there may be certain circumstances where it is desirable to produce a pulsed stream, i.e., a stream wherein the flow of the carbon dioxide particle sheath 24 and outer jacket 26 can be selectively enabled and disabled (i.e., pulsed). A nozzle assembly for producing such a pulsed stream is shown in FIG. 5.

Figure 5:
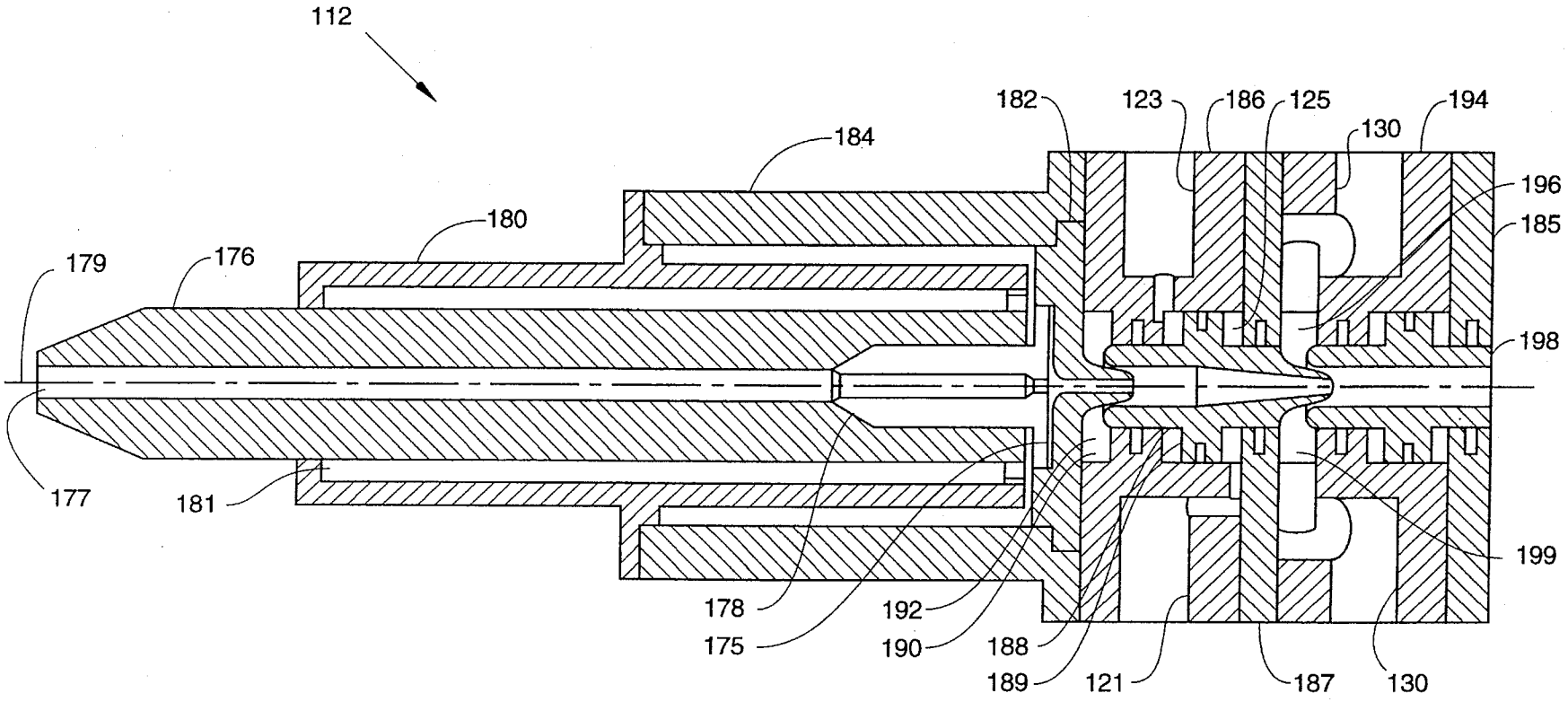
FIG. 5is a cross section view of another embodiment of the tri-state nozzle assembly according to the present invention for producing a pulsed flow.

The pulsating nozzle assembly 112 of FIG. 5 is similar in many respects to the continuous flow nozzle assembly 12 shown in FIGS. 3 and 4, except that the second and third nozzles 188 and 198 are slidably mounted within the nozzle assembly 112, so that the respective annular gaps 192 and 199 for admitting carbon dioxide gas and nitrogen gas can be selectively opened and closed. Consequently, the second embodiment 112 allows the amount of dry ice in the particle sheath as well as the amount of nitrogen gas within the outer jacket 26 to be controlled.

Essentially, the pulsating nozzle assembly 112 shown in FIG. 5 comprises an elongated liquid nitrogen barrel 176 surrounded by an insulating housing 180 and a main support housing 184. As was the case for the first embodiment 12, the second nozzle embodiment 112 includes an annular insulating space 181 between the barrel 176 and the insulating housing 180. Also, the liquid nitrogen barrel 176 includes at one end a flow restricting orifice plug 178. A first nozzle 182 aligned with flow axis 179 is positioned in spaced apart relation to the flow restricting orifice plug 178, so that a small vacuum space 175 is created therebetween. A second nozzle 188 is slidably mounted within cylinder 125 (best seen in FIG. 6) of first base plate 186, so that it is free to slide back and forth in a direction parallel to the flow axis 179. A second base plate 194 supports a third nozzle 198 and is separated from the first base plate 186 by a spacer plate 187. The third nozzle 198 is also slidably mounted within second base plate 194 so that it is free to slide along back and forth in a direction parallel to the flow axis 179. An end cap 185 axially retains the third nozzle 198 in position as shown.

Figure 6:
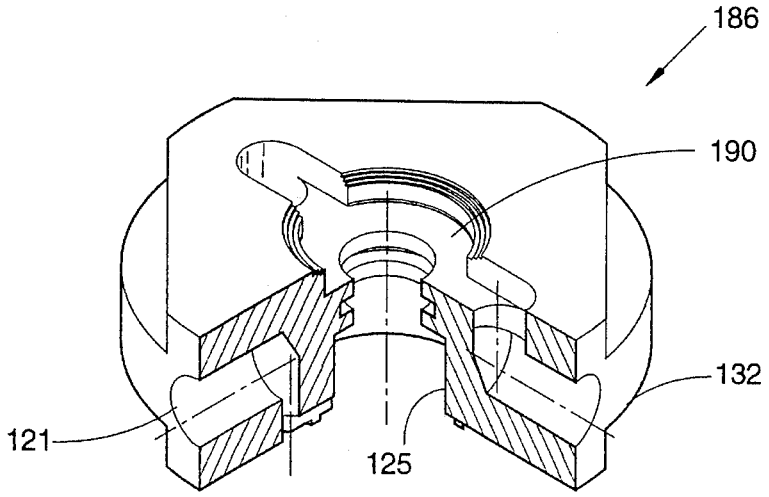
FIG. 6 is a perspective view of the first base plate of the pulsed flow nozzle assembly shown in FIG. 5, but with a portion broken away to more clearly show the structure and arrangement of the hydraulic passages and carbon dioxide inlets.

The first and second base plates 186 and 194 are identical and are best described by simultaneous reference to FIGS. 5 and 6. As was the case for the first base plate 86 in the first nozzle assembly embodiment 12, the first base plate 186 in the second nozzle assembly embodiment 112 includes a first chamber 190 that is fluidically connected to the pair of carbon dioxide inlet passages 132 (only one inlet passage 132 can be seen in FIG. 6). However, base plate 186 also includes a pair of hydraulic ports 121 (FIG. 6) and 123 (FIG. 5) that communicate with opposite sides of the nozzle cylinder 125, as best seen in FIG. 5. Hydraulic pressure can then be selectively applied to opposite sides of the flange 189 on the second nozzle 188, thus forcing the nozzle 188 to oscillate back and forth within nozzle cylinder 125. The second nozzle 188 is designed to close the gap 192 when it is moved all the way to the left. Conversely, when the nozzle 188 is moved all the way to the right, the gap 192 is the largest. Therefore, a suitable hydraulic control device (not shown) can be used to provide alternating hydraulic pressure to opposite sides of the flange 189, thus move the nozzle 188 back and forth to control the amount of carbon dioxide particles in the stream. If the second nozzle 188 is oscillated back and forth, a pulsed particle flow can be achieved. The third nozzle 198 is identically mounted within second base plate 194, and can be similarly oscillated to produce a pulsating gaseous nitrogen outer jacket 26.

Finally, while the respective first and second base plates 186 and 194 are identical, they are shown in FIG. 5 mounted at a 90° offset so that the details of the respective hydraulic ports 121 and 123 and the nitrogen inlets 130 can be seen more easily.

This completes the detailed description of the preferred embodiments of the cutting and abrading system 10 according to the present invention. While a number of specific components were described above for the preferred embodiments of this invention, persons skilled in this art will readily recognize that other substitute components or combinations of components may be available now or in the future to accomplish functions comparable to those of the apparatus according to this invention. For example, numerous sublimable materials may be used with the present invention depending on the particular application or the desired characteristics of the stream. Likewise, many other configurations for the fluid delivery system are possible and the invention could be used with any fluid delivery system capable of supplying the various constituent materials to the nozzle assembly at the appropriate pressures. Accordingly, the present invention should not be regarded as limited to the constituent materials and fluid delivery systems shown and described herein.

Other possible substitutes have been mentioned throughout this description, and many more equivalents are possible. For example, the nozzle assemblies 12 and 112 are not limited to the specific structures and configurations shown in the drawings, and several alternative configurations for achieving the same functions would be obvious to persons having ordinary skill in the art after having become familiar with the details of this invention. Therefore, it would be feasible to someone having ordinary skill in the art, in light of this disclosure, to assemble the necessary components to practice this invention, regardless of whether some of such components might not be the same as those described herein.

Consequently, the foregoing is considered illustrative only of the principles of the invention, and all suitable modifications and equivalents may be resorted to as falling within the scope of the invention as defined by the claims which follow.

The embodiments of the invention in which an exclusive property or privilege is claimed are defined as follows:

1. Apparatus for cutting and abrading an object, comprising:

first gas delivery means for providing a first gas in a liquid form at a first pressure and for providing the first gas in a gas form at a second pressure;

second gas delivery means for providing a second gas in a gas form at a third pressure; and nozzle means connected to said first gas delivery means and said second gas delivery means for producing a stream having a central jet comprising the first gas in a liquid form, a particle sheath surrounding the central jet comprising solidified particles of the second gas, the second gas solidifying upon contact with the first gas in a liquid form in the central jet, and an outer jacket surrounding the particle sheath comprising the first gas in a gas form.

2. The system for cutting and abrading an object of claim 1, wherein said first gas delivery means includes:

a reservoir containing a supply of said first gas in liquid form;

a first pump connected to said reservoir for pressurizing said first gas in liquid form to a fourth pressure;

vaporizing means connected to said first pump for vaporizing said first gas in liquid form to produce a vaporized first gas;

pressure regulating means connected to said vaporizing means for maintaining the vaporized first gas at the second pressure;

a second pump connected to said vaporizing means for pressurizing the vaporized first gas to the first pressure; and condensing means connected to said second pump for liquefying the vaporized first gas from said second pump.

3. The system for cutting and abrading an object of claim 2, wherein said second gas delivery means includes:

a reservoir containing a supply of the second gas in gas form; and pressure regulating means connected to said reservoir for maintaining the second gas at said third pressure.

4. The system for cutting and abrading an object of claim 3, wherein the first gas comprises nitrogen.

5. The system for cutting and abrading an object of claim 4, wherein the second gas comprises carbon dioxide.

6. The system for cutting and abrading an object of claim 5, wherein the first pressure is about 30,000 to 70,000 pounds per square inch gauge and wherein the second pressure is about 0 to 6,000 pounds per square inch gauge.

7. The system for cutting and abrading an object of claim 6, wherein the third pressure is about 20 to 2,000 pounds per square inch gauge.

8. The system for cutting and abrading an object of claim 7, wherein the fourth pressure is at least as great as the second pressure.

9. The system for cutting and abrading an object of claim 8, including collection means for collecting particles abraded from the object, said collection means surrounding said nozzle means and the object.

10. The system for cutting and abrading an object of claim 1, wherein said nozzle means includes:

a first nozzle having an inlet end and an outlet end oriented along a flow axis;

a second nozzle having an inlet end and an outlet end oriented along the flow axis and positioned in spaced-apart relation to said first nozzle so that a first gap is formed between the outlet end of said first nozzle and the inlet end of said second nozzle;

a third nozzle having an inlet end and an outlet end oriented along the flow axis and positioned in spaced-apart relation with said second nozzle so that a second gap is formed between the outlet end of said second nozzle and the inlet end of said third nozzle;

first delivery means for introducing the first gas in liquid form into the inlet end of said first nozzle;

second delivery means for introducing the second gas in gas form into the first gap; and third delivery means for introducing the first gas in gas form into the second gap.

11. A method for producing a particle stream, comprising the steps of:

creating a high velocity jet of liquified gas by passing first gas in liquid form through a first nozzle;

directing the high velocity jet of liquified gas through a second nozzle, said second nozzle having an inlet therein;

passing a second gas through said inlet in said second nozzle so that said second gas comes in contact with said high velocity jet of liquified gas, the second gas solidifying when said contact is made in order to form a particle sheath adjacent the high velocity jet of liquified gas;

directing the high velocity jet of liquified gas and particle sheath from said second nozzle into a third nozzle, said third nozzle having an inlet therein; and passing a supply of first gas in vapor form through said inlet in said third nozzle so that said first gas in vapor form flows around said particle sheath in order to form a jacket around said sheath.

12. A nozzle assembly, comprising:

a first nozzle having an inlet end and an outlet end oriented along a flow axis;

a second nozzle having an inlet end and an outlet end oriented along the flow axis and positioned in spaced-apart relation to said first nozzle so that a first gap is formed between the outlet end of said first nozzle and the inlet end of said second nozzle;

a third nozzle having an inlet end and an outlet end oriented along the flow axis and positioned in spaced-apart relation with said second nozzle so that a second gap is formed between the outlet end of said second nozzle and the inlet end of said third nozzle;

first delivery means for introducing a liquified gas into the inlet end of said first nozzle;

second delivery means for introducing a gas into the first gap; and third delivery means for introducing a gas into the second gap.

13. The nozzle assembly of claim 12, wherein said second delivery means comprises a first chamber in fluid communication with the first gap, and wherein said third delivery means comprises a second chamber in fluid communication with the second gap.

14. The nozzle assembly of claim 13, wherein said second and third nozzles are slidably mounted along the flow axis, said nozzle assembly further comprising first means for moving said second nozzle along said flow axis within said nozzle assembly and second means for moving said third nozzle along said flow axis within said nozzle assembly.

15. A nozzle assembly, comprising:

a first nozzle having an inlet end and an outlet end oriented along a flow axis;

a second nozzle having an inlet end and an outlet end, said second nozzle being slidably mounted within said nozzle assembly along the flow axis thereof so that said second nozzle can be moved outwardly from said first nozzle within said nozzle assembly in order to form a first gap therebetween;

a third nozzle having an inlet end and an outlet end, said third nozzle being slidably mounted within said nozzle assembly along the flow axis thereof so that said third nozzle can be moved outwardly from said second nozzle within said nozzle assembly to form a second gap therebetween;

first positioning means connected to said second nozzle for moving said second nozzle within said nozzle assembly relative to said first nozzle;

second positioning means connected to said third nozzle for moving said third nozzle within said nozzle assembly relative to said second nozzle;

first delivery means for introducing a liquified gas into the inlet end of said first nozzle;

second delivery means for introducing a gas into the first gap; and third delivery means for introducing a gas into the second gap.

16. The nozzle assembly of claim 15, wherein said second nozzle is slidably mounted within a cylinder and includes a flange positioned between the inlet end and the outlet end of said second nozzle, said cylinder being adapted to expose opposite sides of the flange on said second nozzle to hydraulic pressure.

17. The nozzle assembly of claim 16, wherein said third nozzle is slidably mounted within a cylinder and includes a flange positioned between the inlet end and the outlet end of said third nozzle, said cylinder being adapted to expose opposite sides of the flange on said third nozzle to hydraulic pressure.

18. Apparatus for cutting and abrading an object, comprising:

a liquid nitrogen reservoir containing a supply of liquid nitrogen;

a carbon dioxide reservoir containing a supply of carbon dioxide gas;

a first pump connected to said liquid nitrogen reservoir for pressurizing the liquid nitrogen to a first pressure;

vaporizing means connected to said first pump for vaporizing the liquid nitrogen at the first pressure to produce nitrogen gas;

a second pump connected to said vaporizing means for pressurizing the nitrogen gas to a second pressure;

condensing means connected to said second pump for liquefying the nitrogen gas at the second pressure to produce high pressure liquid nitrogen; and nozzle means connected to said carbon dioxide reservoir, said vaporizing means, and said condensing means for producing a stream having a central jet produced from the high pressure liquid nitrogen, a particle sheath comprising solidified particles of carbon dioxide gas surrounding the central jet, the carbon dioxide gas solidifying upon contact with the liquid nitrogen in the central jet, and an outer jacket comprising nitrogen gas surrounding the particle sheath.

19. The system for cutting and abrading an object of claim 18, including a first pressure regulator connected to said system between said vaporizing means and said nozzle means for maintaining the nitrogen gas at said first pressure, a second pressure regulator connected to said system between said condensing means and said nozzle means for maintaining the liquid nitrogen at said second pressure, and a third pressure regulator connected to said system between said carbon dioxide reservoir and said nozzle means for maintaining the carbon dioxide gas at a third pressure.

20. The system for cutting and abrading an object of claim 19, wherein said first pressure is in the range of about 0 pounds per square inch gauge to 6,000 pounds per square inch gauge, said second pressure is in the range of about 30,000 pounds per square inch gauge to 70,000 pounds per square inch gauge, and said third pressure is in the range of about 20 pounds per square inch gauge to 2,000 pounds per square inch gauge.

21. The system for cutting and abrading an object of claim 20, wherein said nozzle means includes:

a first nozzle having an inlet end and an outlet end oriented along a flow axis;

a second nozzle having an inlet end and an outlet end oriented along the flow axis and positioned in spaced-apart relation to said first nozzle so that a first chamber is formed between the outlet end of said first nozzle and the inlet end of said second nozzle, said first nozzle and said second nozzle also being positioned relative to each other so that a first gap is formed therebetween, said first gap being located within said first chamber;

a third nozzle having an inlet end and an outlet end oriented along the flow axis and positioned in spaced-apart relation with said second nozzle so that a second chamber is formed between the outlet end of said second nozzle and the inlet end of said third nozzle, said second nozzle and said third nozzle also being positioned relative to each other so that a second gap is formed therebetween, said second gap being located within said second chamber;

first delivery means for introducing the high pressure liquid nitrogen into the inlet end of said first nozzle, said first nozzle producing a high velocity liquid nitrogen jet;

second delivery means for introducing the carbon dioxide gas into the first chamber, whereby the carbon dioxide gas passes through said first gap and enters said second nozzle, solidifies upon contact with the high velocity liquid nitrogen jet and produces a particle sheath around the high velocity liquid nitrogen jet; and third delivery means for introducing the nitrogen gas into the second chamber, whereby the nitrogen gas passes through said second gap and enters the third nozzle and produces a high velocity gaseous nitrogen outer jacket around the particle sheath and high velocity liquid nitrogen jet.

* * * * *